US006491466B1

(12) United States Patent
Eguchi et al.

(10) Patent No.: US 6,491,466 B1
(45) Date of Patent: Dec. 10, 2002

(54) APPLICATOR FOR FLUID

(75) Inventors: Tamotsu Eguchi, Fujioka (JP); Kenzi Sato, Maebashi (JP); Makoto Ono, Tano-gun (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/980,401

(22) PCT Filed: May 23, 2000

(86) PCT No.: PCT/JP00/03282

§ 371 (c)(1), (2), (4) Date: Dec. 3, 2001

(87) PCT Pub. No.: WO00/74864

PCT Pub. Date: Dec. 14, 2000

(30) Foreign Application Priority Data

Jun. 3, 1999 (JP) ..... 11-157089

(51) Int. Cl.[7] ..... B43K 5/18; B43K 5/00; B43K 7/02; B43K 8/03

(52) U.S. Cl. ..... 401/142; 401/205; 401/219

(58) Field of Search ..... 401/142, 205, 401/219, 141

(56) References Cited

U.S. PATENT DOCUMENTS 5,977,211 A 11/1999 Koyama

FOREIGN PATENT DOCUMENTS

| | | |
|---|---|---|
| JP | 8-52981 | 2/1996 |
| JP | 8-192594 | 7/1996 |
| JP | 11-59061 | 3/1999 |
| JP | 2-41151 | 11/1999 |
| JP | 2000-343879 | * 12/2000 |
| WO | WO 86/04345 | 7/1986 |

* cited by examiner

*Primary Examiner*—David J. Walczak
*Assistant Examiner*—Kathleen J. Prunner
(74) *Attorney, Agent, or Firm*—Burns, Doane, Swecker & Mathis LLP

(57) ABSTRACT

An applicator includes a reservoir charged with fluid. The reservoir has a discharge-controlling mechanism at one end for applying the fluid. The fluid contains at least one organic solvent, such as mythylcyclohexane, and is charged with a scarcely volatile liquid substance, such as an alkylene oxide adduct of diglycerin, having no compatibility with the applying fluid. The scarcely volatile liquid substance forms a movable plug for an end part of the applying fluid in a contact state and the rear of the plug in the reservoir is released to the atmosphere. The applicator can include writing instruments including a felt tip pen and a ballpoint pen, a corrector, an applicator for adhesive and a dressing instrument.

12 Claims, No Drawings

APPLICATOR FOR FLUID

TECHNICAL FIELD

The present invention relates to an applicator for fluid, specifically to an applicator for fluid used for writing instruments including a felt tip pen and a ballpoint pen, a corrector, an applicator for adhesive and a dressing instrument.

BACKGROUND ART

An applicator such as a ballpoint pen which is equipped with a liquid movable plug at an end part of a fluid contained in a pipe-shaped reservoir in order to prevent the applying fluid from splashing and vaporizing has so far widely been known. Used as such a conventional liquid movable plug are those comprising non-volatile oils as a principal component such as mineral oil, silicone oil, ester oil and polybutene. However, while they have a volatilization-preventing effect for inks in which volatile liquids having a high polarity such as water are blended, there are problems in that inks in which blended are volatile solvents having a low polarity such as xylene, cyclohexane, methylcyclohexane and ethyl acetate dissolve the liquid movable plugs or pass through the movable plugs to volatilize. Accordingly, they have not yet been put to practical use. The volatile solvents having a low polarity are preferred since the drawn lines are liable to be quickly dried when blended in inks and they have a strong sticking property onto a non-absorbing face and are less liable to cause a water-based ink to bleed when they are used for correction liquids.

Further, a solid movable plug using silicone rubber is available, but a volatilization-preventing effect is unsatisfactory for fluids in which the foregoing volatile solvents having a low polarity are blended, and there used to be a problem that the rubber swells and can not move. In applicators such as a corrector charged with inks in which the foregoing volatile solvents having a low polarity are blended, proposed are those of a type in which a container is closed without providing a movable plug. In this case, however, a variation of an ambient temperature changes the internal pressure, so that there used to be inconveniences that the internal pressure is elevated at a high temperature and the ink flows out too much in using and that the internal pressure is lowered at a low temperature and the ink does not flow out smoothly. In addition thereto, in ink fluids in which pigments such as carbon black and titanium dioxide are used for a colorant, there used to be an inconvenience that these pigments settle down as time passes, so that the applicator has to be shaken violently in using to stir the fluids again.

An object of the present invention is to provide an applicator for fluid in which an applying fluid containing a colorant and using a volatile solvent having a low polarity such as xylene, cyclohexane, methylcyclohexane and ethylcyclohexane which are supposed to be suited to blending in inks in terms of a drying property of the drawn lines, a sticking property and are less liability to cause bleeding is excellently prevented from backleaking and discharges smoothly without being influenced by a variation of an ambient temperature and which is easy to use. Another object of the present invention is to provide an applicator for fluid which can inhibit a colorant from settling down and control "feathering" on a member to be applied and which is excellent in an effect to prevent degradation in the. quality of the applying fluid over a long period of time.

DISCLOSURE OF THE INVENTION

In order to achieve the objects described above, the present inventors have investigated various combinations of liquid movable plugs with applying fluids charged into a reservoir of an applicator equipped with a discharge-controlling mechanism for an applying liquid such as a ballpoint pen type tip and a needle valve at an end thereof. As a result thereof, it has been have found that the objects can be achieved by providing a movable plug of a liquid substance which is not compatible with an applying fluid and which has a high polarity and is scarcely volatile and releasing the rear part of the movable plug to the atmosphere. Thus, the present invention has come to be completed.

That is, the applicator for fluid of the present invention is characterized by that a reservoir of an applicator equipped with a discharge-controlling mechanism for an applying fluid at an end thereof is charged with the applying fluid containing at least one organic solvent selected from the following A group: n-hexane, n-heptane, n-octane, isooctane, cyclohexane, methylcyclohexane, ethylcyclohexane, toluene and xylene and that at least one scarcely volatile liquid substance selected from the following B group having no compatibility with the above applying fluid: glycerin, diglycerin, polyglycerin, polyethylene glycol, polypropylene glycol, alkylene glycol alkyl ethers, polyglycerin fatty acid esters, alkylene oxide adducts of glycerin, alkylene oxide adducts of diglycerin and alkylene oxide adducts of polyglycerin is charged thereinto as a movable plug for an end part of the applying fluid in a contact state and the rear of the above movable plug in the reservoir is released to the atmosphere.

The applying fluid of the present invention described above is preferably a gelatinous matter to which a structural viscosity-providing material is added and which has a viscosity of 200 mPa·S or less at a shearing rate of 400 $S^{-1}$ and a viscosity of 300 mPa·S or more at a shearing rate of 5 $S^{-1}$ at a temperature of 25° C.

This makes it easy to inhibit settling of the pigment when a heavy pigment (titanium oxide and the like) is blended as a colorant in an applying fluid and provides the effect that "feathering" on the member to be applied can be inhibited by having a structural viscosity when an ink (fluid) is applied on a member to be applied such as paper.

Further, the movable plug for an end part of the applying fluid described above in the present invention is preferably a gelatinous structural viscous matter obtained by adding a structural viscosity-providing material to a scarcely volatile liquid substance.

This makes it less liable to allow the movable plug of the gelatinous structural viscous matter to transfer to the applying fluid, makes it possible to maintain the quality as a backleaking-preventing body and provides an effect to prevent degradation in the quality of the applying fluid over a long period of time.

Further, the movable plug described above in the present invention is preferably a matter obtained by impregnating a cylindrical spongy continuous porous body with a scarcely volatile liquid.

This elevates an impact resistance of the movable plug, inhibits the scarcely volatile liquid from flowing in the continuous porous body such as sponge, makes it further less liable to physically mix with the applying fluid, makes it possible to maintain the quality as a backleaking-preventing body and provides an effect to prevent degradation in the quality of the applying fluid over a long period of time.

BEST MODE FOR CARRYING OUT THE INVENTION

The embodiment of the present invention shall be explained below in details.

The applicator for fluid which is intended in the present invention is a writing instrument including a felt tip pen and a ballpoint pen, a corrector, an applicator for adhesive and a dressing instrument. Usually, such applicator for fluid is equipped at an end with a discharge-controlling mechanism which prevents the fluid from being discharged too much or scarcely discharged in using. For example, when the fluid (ink or the like) is gelatinous, preferred is an applicator equipped with a ballpoint pen type tip having a structural viscosity-breaking means or a valve which is protruded and forced against a front seat with a resilient body to close a tip hole or an applicator equipped with a discharge-controlling mechanism such as a needle valve.

A reservoir comprising a pipe-shaped container in such applicator is charged with an applying fluid. The applying fluid is prepared by dissolving or dispersing a colorant including a pigment such as carbon black and titanium dioxide and a dye and others in at least one organic solvent selected from the following A group: n-hexane, n-heptane, n-octane, isooctane, cyclohexane, methylcyclohexane, ethylcyclohexane, toluene and xylene. A characteristic common to the A group used in this case is an organic solvent having a relatively high volatility and a low polarity which has a vapor pressure of 1 mm Hg or more at 20° C. and a solubility parameter $\delta$ of 10 or more.

In the present invention, capable of being used are those prepared by blending such volatile organic solvents having a low polarity with a colorant, a structural viscosity-providing agent, a resin as a thickener and a binder which is soluble in the solvents, surfactants, a perfume and other optional additives according to uses. With respect to blending amounts thereof, preferred is a blending composition comprising, for example, 20 to 85 parts of the organic solvent, 10 to 60 parts of the colorant such as a pigment and 5 to 30 parts of the resins and the others.

In the present invention, the foregoing applying fluid may be used as it is but is preferably used particularly in the form of a gelatinous viscous matter. A structural viscosity-providing agent is blended with the fluid described above in order to prepare the gelatinous viscous matter. The fluid described above is blended with a structural viscosity-providing agent to prepare the gelatinous viscous matter. Usually, various substances are used as the viscosity-providing agent. The results of investigations made by the present inventors show that it was effective to the organic solvents comprising the A group described above to use at least one selected from fine powder silica, organic-treated bentonite, 12-hydroxystearic acid and derivatives thereof, hardened castor oil and derivatives thereof, N-lauroyl-$\alpha,\gamma$-di-n-butyramide, paraffin wax and polyethylene wax.

The viscosity-providing agent is preferably blended so that a gelatinous viscous fluid to which such viscosity-providing agent is added has a viscosity of 200 mPa·S or less at a shearing rate of 400 $S^{-1}$ and a viscosity of 300 mPa·S or more at a shearing rate of 5 $S^{-1}$ at a temperature of 25° C.

This makes it easy to inhibit settling of the pigment when a colorant such as a heavy pigment (titanium oxide and the like) is blended with the applying fluid and provides the effect that "feathering" on the member to be applied can be inhibited by having a structural viscosity when the ink (fluid) is applied on a member to be applied such as paper. The apparent viscosity grows large in a low shearing rate area to inhibit settling of the pigment, and the shearing rate is elevated by virtue of rotation of a ball at the tip in writing to lower the apparent viscosity, whereby the ink is smoothly discharged. This gel strength is suitably controlled by a particle diameter and a specific gravity of the colorant (pigment or the like) used.

The present invention is characterized by that the reservoir of the applicator is charged with the applying fluid (particularly gelatinous viscous fluid) described above and that a scarcely volatile liquid substance having no compatibility with the above applying fluid is charged thereinto as a movable plug for an end part of the applying fluid in a contact state and the rear of the above movable plug in the reservoir is released to the atmosphere. This allows the movable plug to move following the applying fluid as the applying fluid is consumed to act as the movable plug. The scarcely volatile liquid substance forming such movable plug used in the present invention is requested to have two performances of "having no compatibility with the applying fluid" and "less liable to be volatilized".

It has been found that at least one scarcely volatile liquid substance having a high polarity selected from the following B group: glycerin, diglycerin, polyglycerin, polyethylene glycol, polypropylene glycol, alkylene glycol alkyl ethers, polyglycerin fatty acid esters, alkylene oxide adducts of glycerin, alkylene oxide adducts of diglycerin and alkylene oxide adducts of polyglycerin is most preferred as the scarcely volatile liquid substance which is suitable as the movable plug satisfying the above two performances.

In the present invention, the scarcely volatile liquid substance described above may be charged into the end part of the applying fluid in a contact state in the form of a liquid layer as it is and used as a movable plug. In this case, a height of the liquid layer is preferably controlled to 20 to 30 mm. However, when the reservoir has a too large inner diameter, there is the possibility that the liquid substance of the movable plug transfers to the applying fluid.

In addition thereto, the preferred movable plug of the present invention is one in which the structural viscosity-providing material described above is added to a scarcely volatile liquid substance to prepare a gelatinous structural viscous matter that is charged in a contact state with the end part of the applying fluid. In this case, the liquid layer may have a height of 10 to 15 mm, and the movable plug of the gelatinous structural viscous matter is less liable to transfer to the applying fluid, so that provided are the effects to make it possible to maintain the quality as a backleaking-preventing body and prevent degradation in the quality of the applying fluid over a long period of time.

In the present invention, the scarcely volatile liquid substance described above may be charged into a pipe-shaped container in a contact state with the end part of the applying fluid in the form of a liquid layer as it is and used as a movable plug. In this case, if the pipe-shaped container has a small inner diameter (usually 2 mm or less in the case of uses for a writing instrument and a correction liquid container), both the applying fluid and the movable plug each are stably charged in the pipe-shaped container by virtue of surface tensions possessed by the applying fluid and the movable plug without providing them with a structural viscosity. However, when the inner diameter of the pipe-shaped container is large (usually 3 mm or more in the case of uses for a writing instrument and a correction liquid container) so as to charge a large amount of the applying fluid into the pipe-shaped container, caused is the problem that the movable plug comprising a scarcely volatile liquid itself moves sideward or downward to make a space between the plug and the container wall when the pipe-shaped container is positioned sideward or upward.

Accordingly, the movable plug is provided with a structural viscosity or prepared by impregnating a spongy continuous porous body with a scarcely volatile liquid substance, whereby both the applying fluid and the movable plug can stably be charged into the pipe-shaped container, and provided are the effects to maintain the quality as a backleaking-preventing structure according to the present invention and prevent degradation in the quality of the applying fluid over a long period of time.

More preferred movable plug is one in which a scarcely volatile liquid substance is used in a state that it is impregnated into a foamed body having continuous pores such as polyurethane foam. For example, a matter prepared by impregnating the liquid substance into a spongy continuous porous body which is a cylinder having an inner diameter close to that of the reservoir and a height of 10 to 15 mm is charged in a contact state with the end part of the applying fluid. In this case, the movable plug is increased in an impact resistance regardless of a size of an inner diameter of the reservoir, and the scarcely volatile liquid substance is inhibited from flowing in a continuous porous body such as sponge. In particular, the movable plug does not transfer to the applying fluid and is further less liable to physically mix with the applying fluid, and provided are the effects to make it possible to further elevate and maintain the quality as a backleaking-preventing body and prevent degradation in the quality of the applying fluid over a long period of time.

EXAMPLES

The present invention shall more specifically be explained below with reference to examples, but the present invention shall by no means be restricted by the examples.

"Good" in evaluation results shown in Tables 1 to 3 described later means that the fluid was discharged in a suitable amount when written on paper, and "X" means that the discharge amount was too small and writing was impossible.

An Example Using a Liquid Movable Plug for a Non-gelatinous Applying Fluid

Example 1

The reservoir of an applicator equipped with a ballpoint pen type tip as a discharge-controlling mechanism at an end and a pipe-shaped reservoir comprising nylon 12 and having an inner diameter of 5 mm and an outer diameter of 7 mm was filled with about 2 g of a non-gelatinous fluid A prepared by mixing and dispersing the following blended compositions.

Fluid A:

| | |
|---|---|
| Methylcyclohexane (A group) | 40 parts |
| Acryl resin | 10 parts |
| Titanium dioxide (pigment) | 50 parts |

Further, 0.4 g of a liquid movable plug comprising glycerin was charged into the reservoir in a contact state with an end part of the fluid A, and the rear part of the above movable plug in the reservoir was released to the atmosphere via a small hole. This sample was put in an oven of 50° C. to observe a change in the weight and the state in applying from the tip after one month. The results thereof are shown in Table 1.

Examples Using a Spongy Movable Plug for a Non-gelatinous Applying Fluid

Example 2

The reservoir of an applicator equipped with a ballpoint pen type tip as a discharge-controlling mechanism at an end and a pipe-shaped reservoir comprising nylon 12 and having an inner diameter of 5 mm and an outer diameter of 7 mm was filled with about 2 g of a non-gelatinous fluid A prepared by mixing and dispersing the following blended compositions.

Fluid A:

| | |
|---|---|
| Methylcyclohexane (A group) | 40 parts |
| Acryl resin | 10 parts |
| Titanium dioxide (pigment) | 50 parts |

Further, a liquid movable plug prepared by impregnating a cylindrical polyurethane foam having an outer diameter of 5 mm and a height of 10 mm with 0.4 g of an ethylene oxide 13 mol adduct of diglycerin (SC-E750: manufactured by Sakamoto Yakuhin Kogyo Co., Ltd.) was charged into the reservoir in a contact state with an end part of the fluid A, and the rear part of the above movable plug in the reservoir was released to the atmosphere via a small hole. This sample was put in an oven of 50° C. to observe a change in the weight and the state in applying from the tip after one month. The results thereof are shown in Table 1.

Example 3

A change in the weight and the state in applying from the tip were observed under the same conditions as in Example 2, except that methylcyclohexane used in Example 2 was changed to ethylcyclohexane. The results thereof are shown in Table 1.

Example 4

A change in the weight and the state in applying from the tip were observed under the same conditions as in Example 2, except that changed were methylcyclohexane used in Example 2 to n-hexane and the ethylene oxide 13 mol adduct of diglycerin to glycerin. The results thereof are shown in Table 1.

Example 5

A change in the weight and the state in applying from the tip were observed under the same conditions as in Example 2, except that changed were methylcyclohexane used in Example 2 to n-heptane and the ethylene oxide 13 mol adduct of diglycerin to diglycerin. The results thereof are shown in Table 1.

Example 6

A change in the weight and the state in applying from the tip were observed under the same conditions as in Example 2, except that changed were methylcyclohexane used in Example 2 to n-octane and the ethylene oxide 13 mol adduct of diglycerin to polyglycerin (Polyglycerin #310: manufactured by Sakamoto Yakuhin Kogyo Co., Ltd.). The results thereof are shown in Table 1.

Example 7

A change in the weight and the state in applying from the tip were observed under the same conditions as in Example 2, except that changed were methylcyclohexane used in Example 2 to isooctane and the ethylene oxide 13 mol adduct of diglycerin to polyethylene glycol. The results thereof are shown in Table 1.

Example 8

A change in the weight and the state in applying from the tip were observed under the same conditions as in Example 2, except that changed were methylcyclohexane used in Example 2 to cyclohexane and the ethylene-oxide 13 mol adduct of diglycerin to polypropylene glycol. The results thereof are shown in Table 1.

Example 9

A change in the weight and the state in applying from the tip were observed under the same conditions as in Example 2, except that changed were methylcyclohexane used in Example 2 to toluene and the ethylene oxide 13 mol adduct of diglycerin to polyglycerin fatty acid ester thexaglycerin pentaoleate (SY-Glyster PO-500: manufactured by Sakamoto Yakuhin Kogyo Co., Ltd.). The results thereof are shown in Table 1.

Example 10

A change in the weight and the state in applying the tip were observed under the same conditions as in Example 2, except that changed were methylcyclohexane used in Example 2 to xylene and the ethylene oxide 13 mol adduct of diglycerin to an alkylene oxide adduct of diglycerin {propylene oxide 9 mol adduct of diglycerin (SY-DP9: manufactured by Sakamoto Yakuhin Kogyo Co., Ltd.)}. The results thereof are shown in Table 1.

Example 11

A change in the weight and the state in applying from the tip were observed under the same conditions as in Example 2, except that the ethylene oxide 13 mol adduct of diglycerin used in Example 2 was changed to alkylene glycol alkyl ether (triethylene glycol monomethyl ether; reagent). The results thereof are shown in Table 1.

Example 12

A change in the weight and the state in applying from the tip were observed under the same conditions as in Example 2, except that the ethylene oxide 13 mol adduct of diglycerin used in Example 2 was changed to an alkylene oxide adduct of diglycerin {propylene oxide 9 mol adduct of diglycerin (SY-D/9: manufactured by Sakamoto Yakuhin Kogyo Co., Ltd.)}. The results thereof are shown in Table 1.

Example 13

A change in the weight and the state in applying from the tip were observed under the same conditions as in Example 2, except that the ethylene oxide 13 mol adduct of diglycerin used in Example 2 was changed to an alkylene oxide adduct of diglycerin {propylene oxide 20 mol adduct of diglycerin (SC-E1000: manufactured by Sakamoto Yakuhin Kogyo Co., Ltd.)}. The results thereof are shown in Table 1.

Example 14

A change in the weight and the state in applying from the tip were observed under the same conditions as in Example 2, except that the ethylene oxide 13 mol adduct of diglycerin used in Example 2 was changed to an alkylene oxide adduct of polyglycerin {propylene oxide 60 mol adduct of tetraglycerin (manufactured by Sakamoto Yakuhin Kogyo Co., Ltd.)}. The results thereof are shown in Table 1.

Examples Using a Gelatinous Movable Plug for a Gelatinous Applying Fluid

Example 15

The reservoir of an applicator equipped with a ballpoint pen type tip as a discharge-controlling mechanism at an end and a pipe-shaped reservoir comprising nylon 12 and having an inner diameter of 5 mm and an outer diameter of 7 mm was filled with about 2 g of an ink A prepared by mixing and dispersing the following blended compositions, then adding thereto one part of fine powder silica (AEROSIL R972: manufactured by Nippon Aerosil Co., Ltd.) and mixing and dispersing them. A viscosity of this applying liquid at a shearing rate at 25° C. was measured.

Fluid A:

| | |
|---|---|
| Methylcyclohexane (A group) | 40 parts |
| Acryl resin | 10 parts |
| Titanium dioxide (pigment) | 50 parts |

Further, 0.4 g of a gelatinous matter prepared by mixing and dispersing 5 parts of a mixture (COK84: manufactured by Nippon Aerosil Co., Ltd.) of fine powder silica and alumina in 95 parts of the ethylene oxide 13 mol adduct of diglycerin (SC-E750: manufactured by Sakamoto Yakuhin Kogyo Co., Ltd.) was charged as a liquid movable plug into the reservoir in a contact state with an end part of the fluid A, and the rear part of the movable plug in the reservoir was released to the atmosphere via a small hole. This sample was put in an oven of 50° C. to observe a change in the weight and the state in applying from the tip after one month. The results thereof are shown in Table 2.

Example 16

A change in the weight and the state in applying from the tip were observed under the same conditions as in Example 15, except that changed were methylcyclohexane used in Example 15 to ethylcyclohexane and one part of fine powder silica (AEROSIL R972: manufactured by Nippon Aerosil Co., Ltd.) to 0.5 part of organic-treated bentonite (BENTONE SD-1: manufactured by NL Chemicals Co., Ltd.). The results thereof are shown in Table 2.

Example 17

A change in the weight and the state in applying from the tip were observed under the same conditions as in Example 15, except that changed were methylcyclohexane used in Example 15 to n-hexane, one part of fine powder silica (AEROSIL R972: manufactured by Nippon Aerosil Co., Ltd.) to 0.5 part of N-lauroyl-α,γ-di-n-butyramide (GP-1: manufactured by Ajinomoto Co., Inc.) and the ethylene oxide 13 mol adduct of diglycerin to glycerin. The results thereof are shown in Table 2.

Example 18

A change in the weight and the state in applying from the tip were observed under the same conditions as in Example 15, except that changed were methylcyclohexane used in Example 15 to n-heptane, one part of fine powder silica (AEROSIL R972: manufactured by Nippon Aerosil Co., Ltd.) to 5 parts of polyethylene wax (Sanwax 151P: manufactured by Sanyo Chemical Industries, Ltd.) and the ethylene oxide 13 mol adduct of diglycerin to diglycerin. The results thereof are shown in Table 2.

Example 19

A change in the weight and the state in applying from the tip were observed under the same conditions as in Example 15, except that changed were methylcyclohexane used in Example 15 to n-octane, one part of fine powder silica (AEROSIL R972: manufactured by Nippon Aerosil Co., Ltd.) to 0.5 part of hardened castor oil and the ethylene oxide 13 mol adduct of diglycerin to polyglycerin (Polyglycerin #310: manufactured by Sakamoto Yakuhin Kogyo Co., Ltd.). The results thereof are shown in Table 2.

Example 20

A change in the weight and the state in applying from the tip were observed under the same conditions as in Example 15, except that changed were methylcyclohexane used in Example 15 to isooctane, one part of fine powder silica (AEROSIL R972: manufactured by Nippon Aerosil Co., Ltd.) to 0.5 part of 12-hydroxystearic acid and the ethylene oxide 13 mol adduct of diglycerin to polyethylene glycol. The results thereof are shown in Table 2.

Example 21

A change in the weight and the state in applying from the tip were observed under the same conditions as in Example 15, except that changed were methylcyclohexane used in Example 15 to cyclohexane and the ethylene oxide 13 mol adduct of diglycerin to polypropylene glycol. The results thereof are shown in Table 2.

Example 22

A change in the weight and the state in applying from the tip were observed under the same conditions as in Example 15, except that changed were methylcyclohexane used in Example 15 to toluene and the ethylene oxide 13 mol adduct of diglycerin to polyglycerin fatty acid ester (hexaglycerin pentaolate (SY-Glyster PO-500: manufactured by Sakamoto Yakuhin Kogyo Co., Ltd.). The results thereof are shown in Table 2.

Example 23

A change in the weight and the state in applying from the tip were observed under the same conditions as in Example 15, except that changed were methylcyclohexane used in Example 15 to xylene and the ethylene oxide 13 mol adduct of diglycerin to the alkylene oxide adduct of diglycerin {propylene oxide 9 mol adduct of diglycerin (SY-DP9: manufactured by Sakamoto Yakuhin Kogyo Co., Ltd.)}. The results thereof are shown in Table 2.

Example 24

A change in the weight and the state in applying from the tip were observed under the same conditions as in Example 15, except that the ethylene oxide 13 mol adduct of diglycerin used in Example 15 was changed to alkylene glycol ether. The results thereof are shown in Table 2.

Example 25

A change in the weight and the state in applying from the tip were observed under the same conditions as in Example 15, except that the ethylene oxide 13 mol adduct of diglycerin used in Example 15 was changed to the alkylene oxide adduct of diglycerin {propylene oxide 9 mol adduct of diglycerin (SY-DP9: manufactured by Sakamoto Yakuhin Kogyo Co., Ltd.)}. The results thereof are shown in Table 2.

Example 26

A change in the weight and the state in applying from the tip were observed under the same conditions as in Example 15, except that the ethylene oxide 13 mol adduct of diglycerin used in Example 15 was changed to the propylene oxide 20 mol adduct of diglycerin (SC-E1000: manufactured by Sakamoto Yakuhin Kogyo Co., Ltd.). The results thereof are shown in Table 2.

Example 27

A change in the weight and the state in applying from the tip were observed under the same conditions as in Example 15, except that the ethylene oxide 13 mol adduct of diglycerin used in Example 15 was changed to the alkylene oxide adduct of polyglycerin {propylene oxide (60 mol) adduct of tetraglycerin (manufactured by Sakamoto Yakuhin Kogyo Co., Ltd.)}. The results thereof are shown in Table 2.

Comparative Example 1

A sample was prepared in the same manner as in Example 2 to evaluate a change in the weight and the state in applying from the tip under the same conditions, except that the ethylene oxide 13 mol adduct of diglycerin used in Example 2 was changed to a dispersion mixture comprising 67 parts of mineral oil, 30 parts of polybutene and 3 parts of fine powder silica. The results thereof are shown in Table 3.

Comparative Example 2

A sample was prepared in the same manner as in Example 2 to evaluate a change in the weight and the state in applying from the tip under the same conditions, except that the ethylene oxide 13 mol adduct of diglycerin used in Example 2 was changed to a dispersion mixture comprising 97 parts of methyl polysiloxane and 3 parts of fine powder silica. The results thereof are shown in Table 3.

Comparative Example 3

A closed reservoir equipped with a ballpoint pen type tip as a discharge-controlling mechanism at an end was filled with 2 g of the fluid A prepared in Example 1, and this sample was put in an oven of 50° C. to observe a change in the weight and the state in applying from the tip after one month. The results thereof are shown in Table 3.

Comparative Example 4

A sample was prepared in the same manner in Example 15 to evaluate a change in the weight and the state in applying from the tip under the same conditions, except that the movable plug used in Example 15 was changed to a dispersion mixture comprising 67 parts of mineral oil, 30 parts of polybutene and 3 parts of fine powder silica. The results thereof are shown in Table 3.

Comparative Example 5

A sample was prepared in the same manner as in Example 15 to evaluate a change in the weight and the state in applying from the tip under the same conditions, except that the movable plug used in Example 15 was changed to a dispersion mixture comprising 97 parts of methyl polysiloxane and 3 parts of fine powder silica. The results thereof are shown in Table 3.

Comparative Example 6

A sample was prepared in the same manner as in Example 15 to evaluate a change in the weight and the state in applying from the tip under the same conditions, except that one part of fine powder silica contained in the ink A in Example 15 was increased to 3 parts thereof to prepare an ink having a too strong gel strength. The results thereof are shown in Table 3.

Comparative Example 7

A closed reservoir equipped with a ballpoint pen type tip as a discharge-controlling mechanism at an end was filled with 2 g of the fluid A prepared in Example 15, and this sample was put in an oven of 50° C. to observe a change in the weight and the state in applying from the tip after one month. The results thereof are shown in Table 3.

TABLE 1

| | Volatilized amount after one month at 50° C. | Writing characteristic 40° C. | Writing characteristic 5° C. |
|---|---|---|---|
| Example 1 | 10 mg | Good | Good |
| Example 2 | 10 | Good | Good |
| Example 3 | 12 | Good | Good |
| Example 4 | 11 | Good | Good |
| Example 5 | 10 | Good | Good |
| Example 6 | 13 | Good | Good |
| Example 7 | 11 | Good | Good |
| Example 8 | 13 | Good | Good |
| Example 9 | 15 | Good | Good |
| Example 10 | 10 | Good | Good |
| Example 11 | 11 | Good | Good |
| Example 12 | 13 | Good | Good |
| Example 13 | 13 | Good | Good |
| Example 14 | 11 | Good | Good |

TABLE 2

| | Volatilized amount after one month at 50° C. | Writing characteristic 40° C. | Writing characteristic 5° C. | Viscosity (mPa · S) 400 $S^{-1}$ | Viscosity (mPa · S) 5 $S^{-1}$ |
|---|---|---|---|---|---|
| Example 15 | 10 mg | Good | Good | 95 | 2100 |
| Example 16 | 12 | Good | Good | 120 | 1860 |
| Example 17 | 11 | Good | Good | 105 | 1850 |
| Example 18 | 10 | Good | Good | 140 | 2100 |
| Example 19 | 13 | Good | Good | 110 | 2050 |
| Example 20 | 11 | Good | Good | 90 | 2300 |
| Example 21 | 13 | Good | Good | 95 | 2100 |
| Example 22 | 15 | Good | Good | 95 | 2100 |
| Example 23 | 10 | Good | Good | 95 | 2100 |
| Example 24 | 11 | Good | Good | 95 | 2100 |
| Example 25 | 13 | Good | Good | 95 | 2100 |
| Example 26 | 13 | Good | Good | 95 | 2100 |
| Example 27 | 11 | Good | Good | 95 | 2100 |

TABLE 3

| | Volatilized amount after one month at 50° C. | Writing characteristic 40° C. | Writing characteristic 5° C. | Viscosity (mPa · S) 400 $S^{-1}$ | Viscosity (mPa · S) 5 $S^{-1}$ |
|---|---|---|---|---|---|
| Comparative Example 1 | 800 | Dry up | Dry up | — | — |
| Comparative Example 2 | 800 | Dry up | Dry up | — | — |
| Comparative Example 3 | 5 | Too much discharge | Too small discharge | — | — |
| Comparative Example 4 | 800 | Dry up | Dry up | 95 | 2100 |
| Comparative Example 5 | 800 | Dry up | Dry up | 95 | 2100 |
| Comparative Example 6 | 10 | X | X | 250 | 4200 |
| Comparative Example 7 | 5 | Too much discharge | Too small discharge | 95 | 2100 |

Industrial Applicability

According to the present invention described above, the reservoir of the applicator is charged with the applying fluid containing a volatile organic solvent; the scarcely volatile liquid substance which is not compatible with the above applying fluid is charged thereinto as the movable plug for the end part of the applying fluid in a contact state; and the rear of the movable plug in the reservoir is released to the atmosphere. Thus, the applying fluid does dissolve the movable plug or does not pass through the movable plug to volatilize. Accordingly, the movable plug in the present invention moves smoothly following the applying fluid as the applying fluid is consumed, and it is not influenced by a change in an ambient temperature and is excellent in a backleaking-preventing effect. Further, in the present invention, the movable plug comprising a gelatinous structure viscous matter to which a structural viscosity-providing material is added or a cylindrical continuous porous body which is impregnated with the scarcely volatile liquid is less liable to transfer to the applying fluid, can maintain the quality as a backleaking-preventing body and provide an effect to prevent degradation in the quality of the applying fluid over a long period of time. The present invention displays the same effects also when it is applied to a discharge-controlling mechanism equipped to a changeable refill as is the case with a ballpoint pen.

What is claimed is:

1. An applicator for fluid characterized by that a reservoir of the applicator having a discharge-controlling mechanism for applying the fluid at an end thereof is charged with the applying fluid containing at least one organic solvent selected from the following A group: n-hexane, n-heptane, n-octane, isooctane, cyclohexane, methylcyclohexane, ethylcyclohexane, toluene and xylene and that at least one scarcely volatile liquid substance selected from the following B group having no compatibility with the above applying fluid: glycerin, diglycerin, polyglycerin, polyethylene glycol, polypropylene glycol, alkylene glycol alkyl ethers, polyglycerin fatty acid esters, alkylene oxide adducts of glycerin, alkylene oxide adducts of diglycerin and alkylene oxide adducts of polyglycerin is charged thereinto as a movable plug for an end part of the applying fluid in a contact state and the rear of the above movable plug in the reservoir is released to the atmosphere.

2. The applicator for fluid as described in claim 1, wherein the applying fluid is a gelatinous matter to which a structural viscosity-providing material is added and which has a viscosity of 200 mPa·S or less at a shearing rate of 400 $S^{-1}$ and a viscosity of 300 mPa·S or more at a rate of 5 $S^{-1}$ at a temperature of 25° C.

3. The applicator for fluid as described in claim 2, wherein the moveable plug is a gelatinous structural viscous matter obtained by adding a structural viscosity-providing material to a scarcely volatile liquid substance.

4. The application for fluid as described in claim 3, wherein the structural viscosity-providing material is at least one selected from fine powder silica, organic-treated bentonite, 12-hydroxystearic acid and derivatives thereof, hardened castor oil and derivatives thereof, N-lauroyl-α,γ-di-n-butyramide, paraffin wax and polyethylene wax.

5. The applicator fluid as described in claim 2, wherein the moveable plug is a matter obtained by impregnating a cylindrical spongy continuous porous body with a scarcely volatile liquid substance.

6. The application for fluid as described in claim 5, wherein the structural viscosity-providing material is at least one selected from fine powder silica, organic-treated bentonite, 12-hydroxystearic acid and derivatives thereof, hardened castor oil and derivatives thereof, N-lauroyl-α,γ-di-n-butyramide, paraffin wax and polyethylene wax.

7. The application for fluid as described in claim 2, wherein the structural viscosity-providing material is at least one selected from fine powder silica, organic-treated bentonite, 12-hydroxystearic acid and derivatives thereof, hardened castor oil and derivatives thereof, N-lauroyl-α,γ-di-n-butyramide, paraffin wax and polyethylene wax.

8. The applicator for fluid as described in claim 1, wherein the moveable plug is a gelatinous structural viscous matter obtained by adding a structural viscosity-providing material to a scarcely volatile liquid substance.

9. The application for fluid as described in claim 8, wherein the structural viscosity-providing material is at least one selected from fine powder silica, organic-treated bentonite, 12-hydroxystearic acid and derivatives thereof, hardened castor oil and derivatives thereof, N-lauroyl-α,γ-di-n-butyramide, paraffin wax and polyethylene wax.

10. The applicator fluid as described in claim 1, wherein the moveable plug is a matter obtained by impregnating a cylindrical spongy continuous porous body with a scarcely volatile liquid substance.

11. The application for fluid as described in claim 10, wherein the structural viscosity-providing material is at least one selected from fine powder silica, organic-treated bentonite, 12-hydroxystearic acid and derivatives thereof, hardened castor oil and derivatives thereof, N-lauroyl-α,γ-di-n-butyramide, paraffin wax and polyethylene wax.

12. The application for fluid as described in claim 1, wherein the applying fluid is a gelatinous matter to which a structural viscosity-providing material is added and the structural viscosity-providing material is at least one selected from fine powder silica, organic-treated bentonite, 12-hydroxystearic acid and derivatives thereof, hardened castor oil and derivatives thereof, N-lauroyl-α,γ-di-n-butyramide, paraffin wax and polyethylene wax.

* * * * *